United States Patent [19]

Lee et al.

[11] Patent Number: 4,790,785

[45] **Date of Patent: * Dec. 13, 1988**

[54] MEANS AND METHOD FOR MANUFACTURE FOR A HIGH-RESOLUTION COLOR CATHODE RAY TUBE

[75] Inventors: Sae D. Lee, Buffalo Grove; Kazimir Palac, Carpentersville, both of Ill.

[73] Assignee: Zenith Electronics Corporation, Glenview, Ill.

[ * ] Notice: The portion of the term of this patent subsequent to Dec. 15, 2004 has been disclaimed.

[21] Appl. No.: 131,968

[22] Filed: Dec. 11, 1987

Related U.S. Application Data

[63] Continuation of Ser. No. 758,174, Jul. 23, 1985, Pat. No. 4,713,034.

[51] Int. Cl.[4] ..... H01J 9/20

[52] U.S. Cl. ..... 445/45; 313/461

[58] Field of Search ..... 445/45, 52; 430/23; 313/461

[56] References Cited

U.S. PATENT DOCUMENTS

| | | | |
|---|---|---|---|
| 2,761,990 | 9/1956 | Amdursky et al. | 313/408 |
| 2,916,644 | 12/1959 | Kavtz et al. | 313/482 X |
| 3,638,063 | 1/1972 | Tachikawa et al. | 313/348 |
| 3,894,321 | 7/1975 | Moore | 313/482 |
| 3,997,811 | 12/1976 | Tom et al. | 313/482 X |
| 4,094,678 | 6/1978 | Palac | 430/5 |
| 4,100,451 | 7/1978 | Palac | 313/406 X |
| 4,495,437 | 1/1985 | Kume et al. | 313/407 X |
| 4,547,696 | 10/1985 | Strauss | 313/292 |
| 4,591,344 | 5/1986 | Palac | 445/30 |
| 4,713,034 | 12/1987 | Lee et al. | 445/45 |

*Primary Examiner*—Kenneth J. Ramsey

[57] ABSTRACT

Components-in process and assemblies-in-process are disclosed for use in the manufacture of a high-resolution color cathode ray tube having a tensed foil shadow mask. A first component-in-process comprises a faceplate with a target area for receiving at least one pattern of phosphor deposits. The faceplate has attached at preselected, widely spaced locations on the sides thereof a plurality of discrete, detachable first indexing elements. A second component-in-process comprises a shadow mask support assembly having a frame ultimately constituting a part of the tube envelope; the frame supports the shadow mask in precise adjacency to the target area. The frame has attached on the sides thereof a like plurality of discrete, detachable second indexing elements which are in facing adjacency to the first indexing elements on the faceplate when the faceplate and frame are mated. Temporary attachment of the indexing elements is by means of a thermally degradable cement. The faceplate and frame can be interregistered in precise relationship by the temporary use of the first and second indexing elements in the process of screening the pattern of phosphor deposits on the target area and later in the final assembly of the tube. Also disclosed is a method of manufacture of a high-resolution cathode ray tube by the detachable indexing elements according to the invention.

7 Claims, 4 Drawing Sheets

FIG. 2
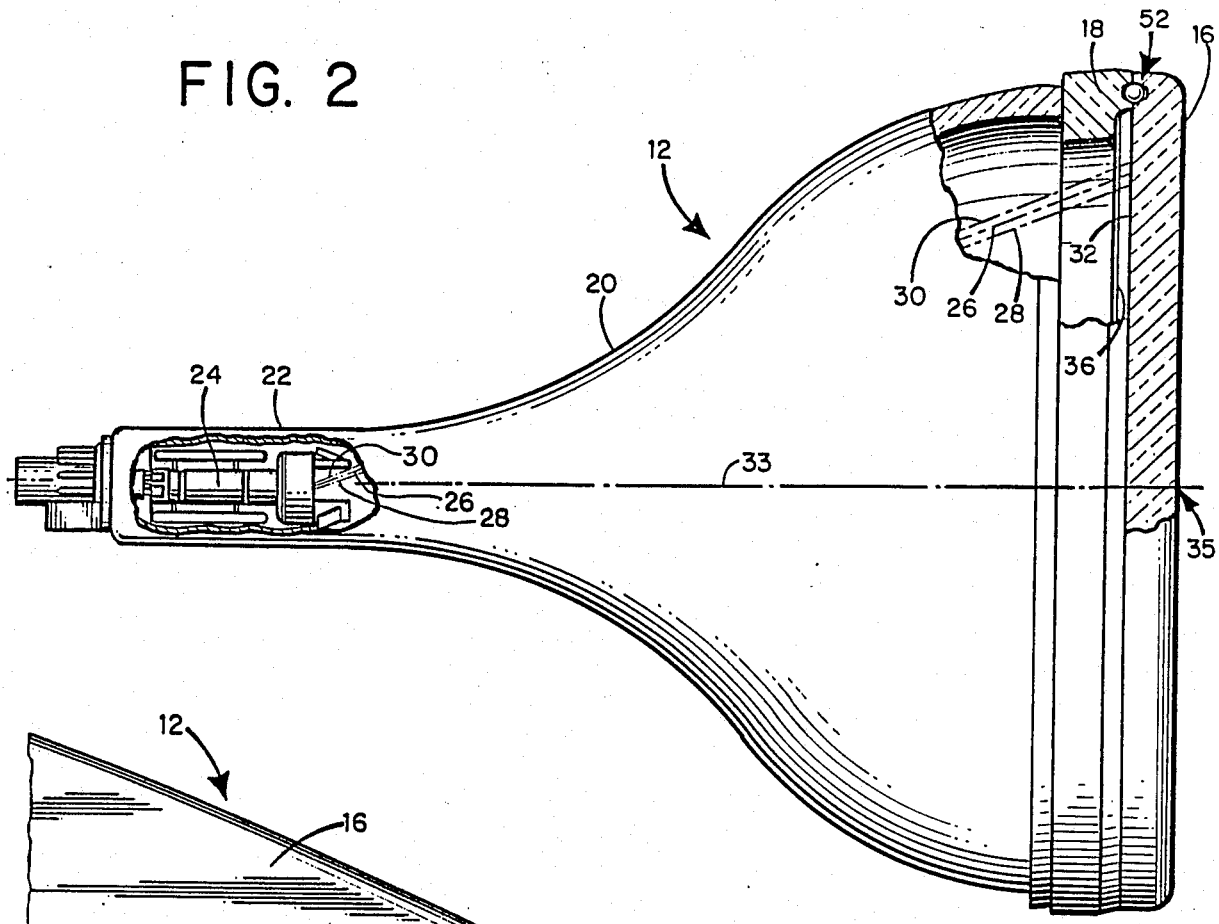
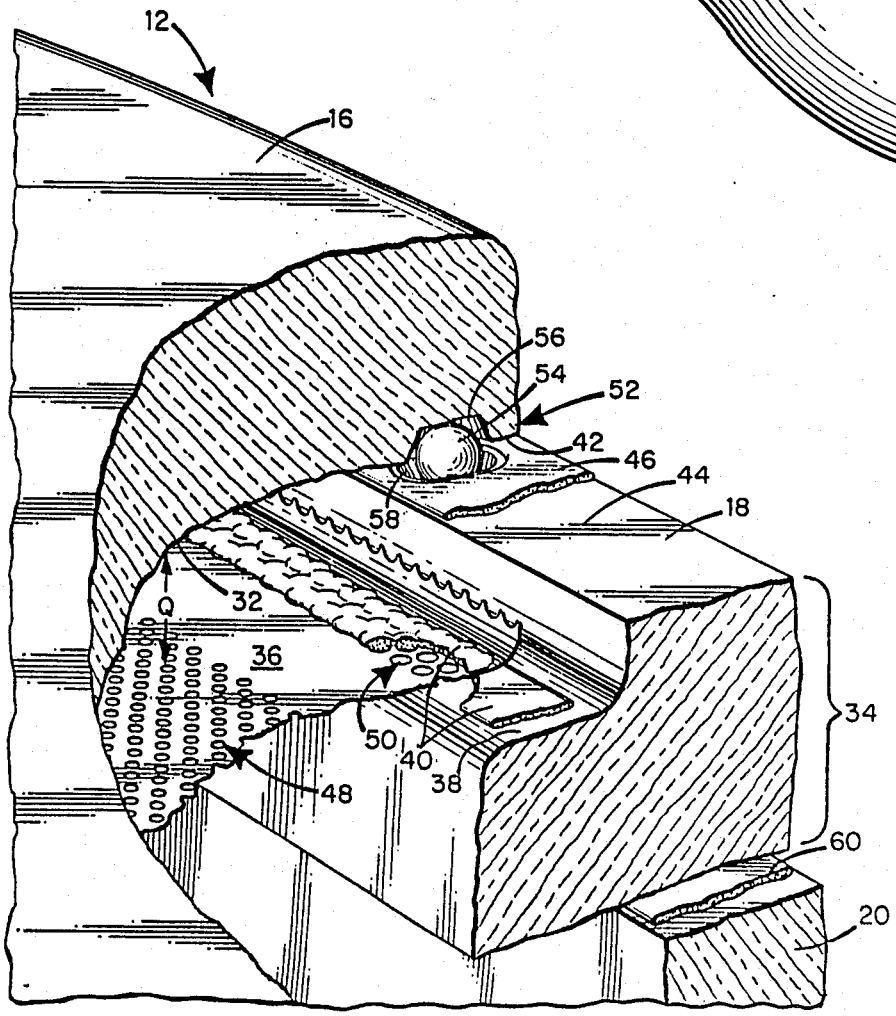
FIG. 3

FIG. 4
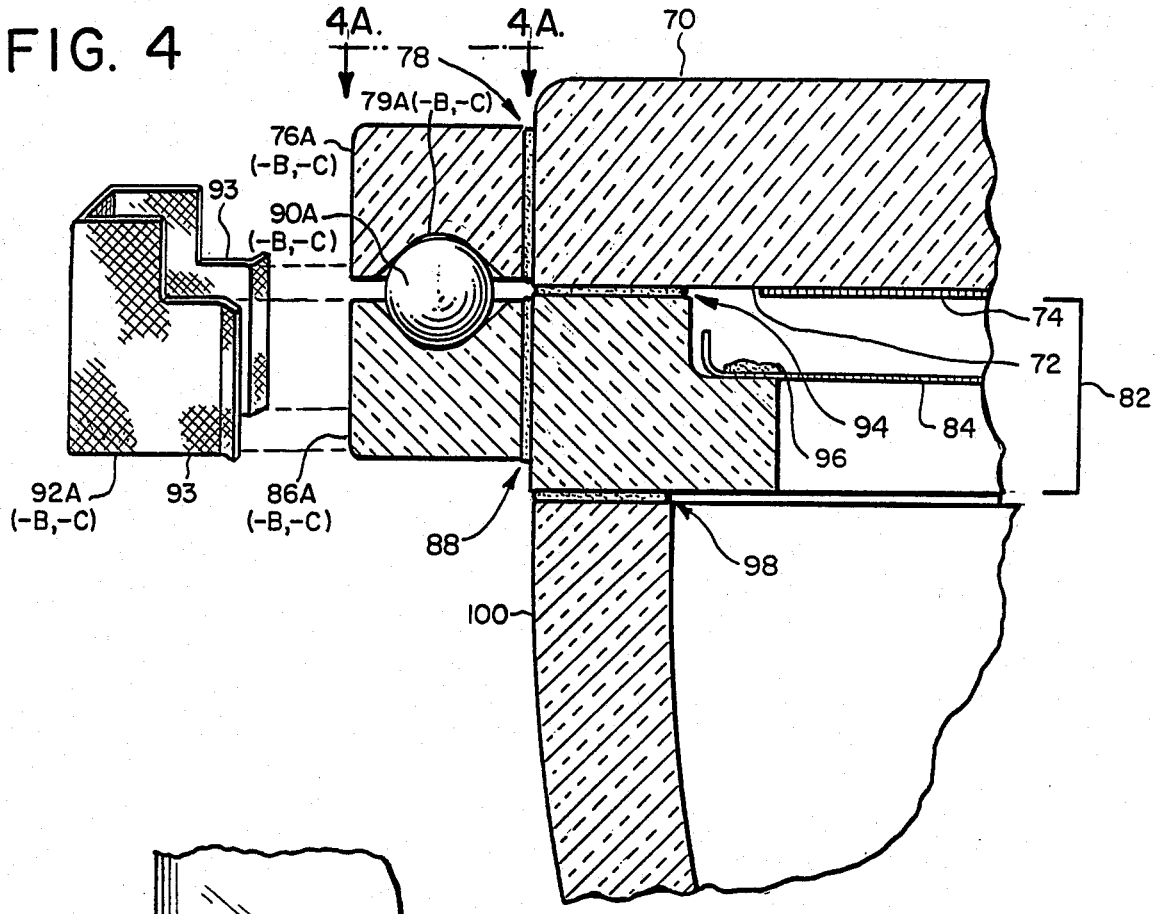
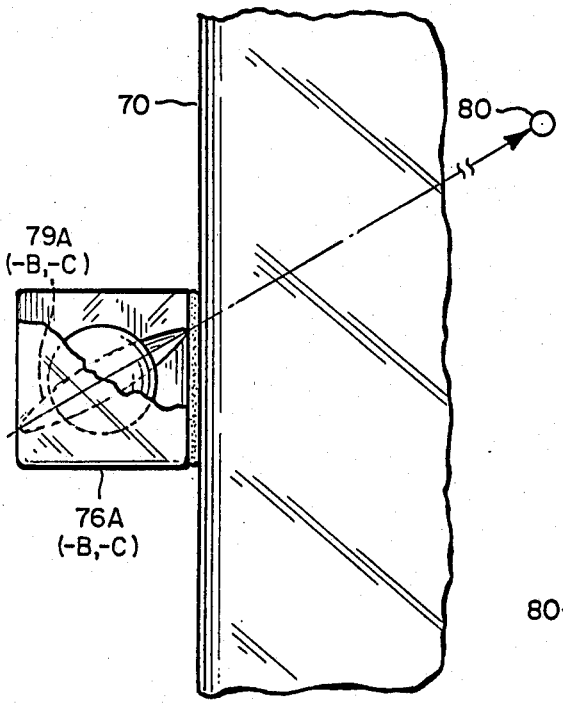
FIG. 4A
FIG. 5
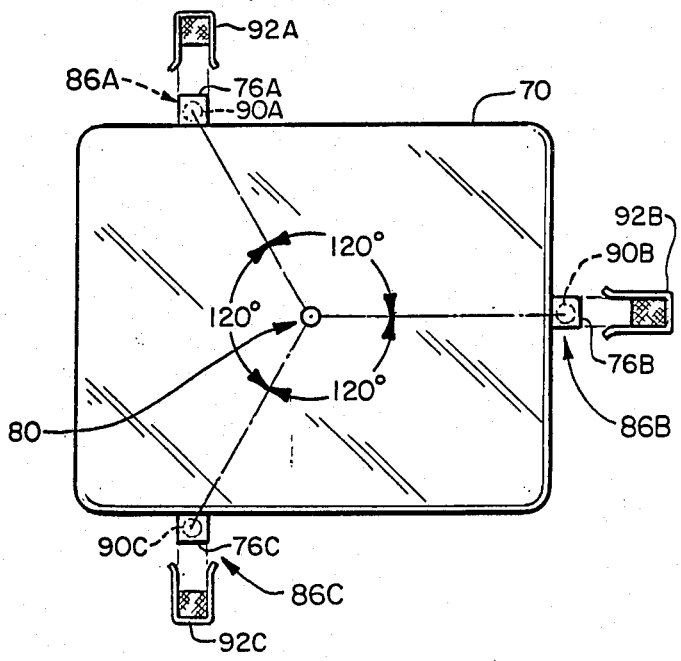

MEANS AND METHOD FOR MANUFACTURE FOR A HIGH-RESOLUTION COLOR CATHODE RAY TUBE

CROSS-REFERENCE TO RELATED APPLICATIONS

This application is a continuation of application Ser. No. 758,174, filed July 23, 1985, now U.S. Pat. No. 4,713,034.

This application is related to but in no way dependent upon copending applications Ser. No. 538,001, now U.S. Pat. No. 4,593,224; Ser. No. 538,003 filed Sept. 30, 1983, now U.S. Pat. No. 4,721,879; Ser. No. 572,088, now U.S. Pat. No. 4,547,696; Ser. No. 572,089 now U.S. Pat. No. 4,595,225; Ser. No. 646,861, now U.S. Pat. No. 4,614,892; Ser. No. 646,862, now U.S. Pat. No. 4,593,225; Ser. No. 735,887, now U.S. Pat. No. 4,656,388; Ser. No. 725,040, now U.S. Pat. No. D289,398, Ser. No. 727,486, now U.S. Pat. No. 4,695,523; and Ser. No. 729,015, now U.S. Pat. No. 4,686,415; Ser. No. 729,020, now U.S. Pat. No. 4,652,791; Ser. No. 754,786; now U.S. Pat. No. 4,672,260; and Ser. No. 754,787, now U.S. Pat. No. 4,712,041, all of common ownership herewith.

BACKGROUND OF THE INVENTION

This invention relates generally to cathode ray picture tubes and is specifically addressed to novel processing means and method for high-resolution cathode ray tubes having shadow masks of the tensed foil type. The invention has particular utility in video monitor applications.

A high-resolution color cathode ray tube that utilizes a tensed foil shadow mask typically includes three electron guns arranged in a delta or in-line configuration. Each gun projects an electron beam through the assigned apertures of a shadow mask, also called a "color selection electrode", onto a target area on the inner surface of the faceplate. The target area comprises a pattern of phosphor deposits arranged in groups of triads of dots. Each of the triads consists of a dot of a red-, green-, and blue-light-emitting phosphor. To improve the brightness of the display and to minimize the incidence of color impurities which can result if a beam falls upon an improper phosphor deposit, the target area may include a layer of a darkish light-absorbing material called a "grille" that surrounds and separates each of the dots. This type of screen is known as a "matrix" or "black surround" screen. Alternately, the phosphor and grille deposits on the target surface may comprise a plurality of vertically oriented, spaced rectangles in coordinate relationship to apertures in the form of rectangles or "slots" in the shadow mask. Tubes of this type are referred to as "slot mask tubes", in contrast to the "dot screen" types of tubes.

The phosphor pattern, whether dots, or stripes, is typically formed by a direct photoprinting process. The target area is first coated with a photosensitive slurry comprising phosphor particles of one of the three phosphors described. The shadow mask, mounted in a frame, is temporarily installed in precise relationship to the faceplate, and the coating is exposed to actinic light projected through the apertures of the mask from a light source located at a position that corresponds to the beam-emission point of the related electron gun. The faceplate is separated from the shadow mask and the coating is "developed" to remove unexposed portions.

The result is a pattern of dots or stripes capable of emitting light of one color, whether red, green or blue. The mask is then reregistered with the faceplate, and the steps are repeated for each of the remaining colors to deposit triads of phosphor deposits on the target area on the faceplate in coordinate relationship with each aperture of the mask. A further step, usually taken before the deposition of the phosphors, is the application of the black surround.

The screening process requires a mechanism whereby the faceplate may be removed and replaced in precise registration with the shadow mask for the black surround and each of the three colors. The conventional "domed" shadow mask, which is mounted on a stiff frame, is made repeatably registrable with the phosphor deposits screened on the faceplate by a suspension system comprising three or four leaf springs. The springs are spot welded to the mask frame at selected points around its periphery. The distal ends of the springs are apertured to engage studs which project inwardly from the rearwardly extending flange of the tube faceplate. Demounting the mask is accomplished by depressing the springs to disengage the studs, and separating the panel from the mask frame usually by automatic machinery. In the remounting, following the deposition of a phosphor, the mask and faceplate are again brought into propinquity whereby the springs are caused to reengage the studs. This process does not lend itself to the screening of a tube that utilizes a foil mask (which is the subject of this application) because of the lack of structural strength of the very thin foil and the very different structures used to support it within the bulb. Therefore, a different means of mask-faceplate referencing is required for tension-mask tubes.

A major problem in manufacturing a color tube is the difficulty in re-aligning the panel with the mask accurately enough to maintain registration between the mask apertures and the associated phosphor deposits. In a high resolution tube which uses a foil-type mask there is a need for great precision in registration. Foil mask thickness is typically about 0.0005 inch, and the diameter of the apertures in a dot screen tube is about 0.0035 inch. The "pitch" (distance between aperture centers) for use in a high-resolution display may be, for example, 0.3 millimeters, and for very high resolution tubes, 0.2 millimeters. With regard to the Q-distance, this measurement is a function of the pitch of the shadow mask. For example, for a given gun design, if the pitch is 0.3 millimeters, the Q-distance may be, by way of example, 0.330 inch. For the very high resolution pitch of 0.2 millimeters, the Q-distance may be about 0.210 inch. These values dictate the need for great precision in the registration and reregistration of the mask and faceplate. For example, a tolerance of $\pm 0.0006$ inch in mask-faceplate registration is acceptable in the manufacture of conventional standard resolution cathode ray tubes having the domed mask. In the manufacture of the high resolution tension mask tubes with which this invention is concerned, however, the allowable tolerance is about $\pm 0.0002$ inch. If this tolerance is exceeded, color purity can be degraded.

External referencing means for a tube having a tensed foil mask is described and claimed in referent copending application Ser. No. 538,001 of common ownership herewith. The referencing means provide for the precise faceplate-mask registration. The faceplate is equipped with three externally mounted, outwardly directed, breakaway pins. Indexing means cooperating with each of the pins comprises a break-away tab affixed to a frame member which supports the shadow mask. Each tab has a depending finger which is provided with a bifurcation at its distal end. To effect registration, the faceplate is located so that the finger bifurcations are poised over the assigned pins. When the assembly is mated, a six-point contact is established between the three pins and their cooperating bifurcations. This registration is repeatable as often as is required to accomplish the screening process, as well as to effect a final registration between the electrode assembly and the faceplate during frit sealing. After frit sealing, the pins and tabs are removable; that is, they can be broken away.

U.S. Pat. No. 3,894,321 to Moore, of common ownership herewith, is directed to a method for processing a color cathode ray tube having a thin foil mask sealed directly to the bulb. Included in this disclosure is a description of the sealing of a foil mask directly between the junction of the faceplate skirt and the funnel. The mask is shown as having two or more alignment holes near the corners of the mask which mate with alignment nipples in the faceplate. The nipples pass through the alignment holes to fit into recesses in the funnel.

U.S. Pat. No. 4,100,451 to Palac, which is assigned to the assignee of the present invention, describes a system for suspending a domed non-self-rigid shadow mask a predetermined distance from a faceplate. Four suspension means provide for coupling and indexing the mask directly to corner portions of the faceplate. In one embodiment, the indexing means comprise legs having rounded portions which engage indexing cavities in the faceplate which may be in the form of V-grooves or slots. Another approach utilizes V-blocks at the four corners of the faceplate, each of which has a clamp attached to the mask. Each clamp has a foot for mating with a V-block. The suspension and indexing means provide for the permanent mounting of the shadow mask in relation to the faceplate, as well as for the temporary mounting of the mask during the production screening process.

Ball-and-groove indexing means are disclosed in the referent copending applications assigned to the assignee of the present invention; namely, Ser. Nos. 572,088 and 572,089; Ser. Nos. 729,015; 735,887; 727,486. The following patents are also noted: 2,761,990; 3,638,063; and 4,495,437.

OBJECTS OF THE INVENTION

It is a general object of the invention to provide improved means and method for use in the manufacture of high-resolution cathode ray tubes.

It is another general object of the invention to provide improved means and method for use in the manufacture of color cathode ray tubes utilizing tensed foil shadow masks.

It is a more specific object of the invention to provide a novel process for establishing precise, repeatable registration between the shadow mask and screen of color cathode ray tubes that utilize the tensed foil shadow mask.

It is a specific object of the invention to provide component-in-process and assembly-in-process means for use in the manufacture of high-resolution tensed-mask color cathode ray tubes.

It is another specific object of the invention to provide improved external referencing means and method for use in the manufacture of high-resolution tensed-mask color cathode ray tubes.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 2 is a side view in elevation of the color cathode ray tube of FIG. 1 showing another view of the components depicted in FIG. 1, together with certain internal components revealed in two cut-away sections;

FIG. 3 is an enlarged cut-away view in perspective of a section of the tube of FIG. 2 showing details of its construction at the component interfaces;

FIG. 4 is a sectioned side view in elevation showing a preferred embodiment of the registration means installed according to the invention;

FIG. 4A is a sectional view taken along lines 4A—4A of FIG. 4 showing the orientation of a component according to the invention with respect to the center axis of the tube;

FIG. 5 is a plan view of a faceplate showing the preferred locations of the registration means according to the invention;

DESCRIPTION OF THE PREFERRED EMBODIMENT

Figure 1:
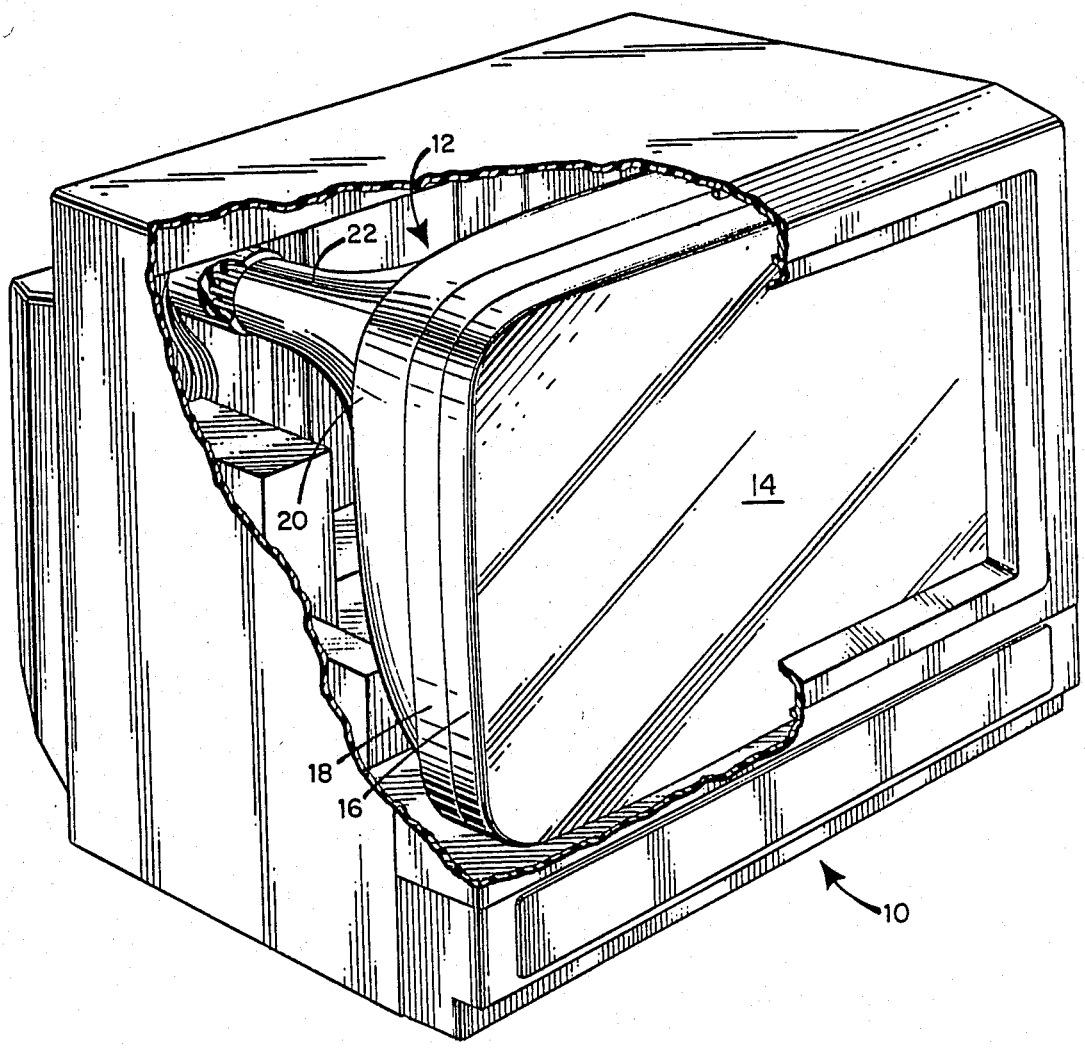
FIG. 1 is a view in perspective of a cabinet that houses a high-resolution color cathode ray tube, showing in a cut-away section certain major components which may be assembled by the means and method according to the invention.

FIG. 1 shows a novel video monitor 10 that houses a high-resolution color cathode ray tube 12, certain components of which can be manufactured according to the present invention. Various features and improvements in the tube 12 are illustrated and described in the referent copending applications assigned to the assignee of the present invention. The design of the monitor is the subject of copending design patent application Ser. No. 725,040 of common ownership herewith. The monitor, and the associated tube, are notable not only for high resolution, but also for the flat imaging area 14 that makes possible the display of images in undistorted form. Imaging area 14 also offers a more complete picture as the corners are relatively square in comparison with the more rounded corners of the conventional cathode ray tube.

High-resolution cathode ray tube 12 is shown in FIGS. 1 and 2 as having a flat glass faceplate 16. Faceplate 16 is depicted as being joined to a color selection electrode frame 18 which in turn is joined to a rear envelope section, here shown as a funnel 20 which tapers down to a narrow neck 22. Neck 22 is shown as enclosing an electron gun 24 which is indicated as projecting three electron beams 26, 28 and 30 on the inner surface 32 of faceplate 16. Inner surface 32 has a pattern of triads of red-emitting, green-emitting, and blue-emitting phosphor deposits which emit light when energized by respective ones of the electron beams 26, 28 and 30. Reference 33 indicates the axis of tube 12 which passes through the centerpoint 35 of the faceplate 16. With additional reference to FIG. 3, there is shown a color selection electrode assembly 34 which comprises the frame 18 and a shadow mask 36. The frame 18 of assembly 34 supports in tension the thin foil shadow mask 36. The tensed mask 36 is spaced a predetermined "Q" distance from the inner surface 32 of faceplate 16. The mask is noted as being flat and parallel with inner surface 32 of faceplate 16.

FIG. 3 shows the attachment of mask 36 to a peripherally continuous recessed support surface 38 located on frame 18; attachment is indicated as being by means of a layer of cement 40. The sealing surface 42 of faceplate 16 is shown as being affixed to the support surface 44 on frame 18, also by a layer of cement 46. The cement may be in the form of a devitrifying glass frit such as that supplied by Corning Glass Works of Corning, New York under the designation Glass 7595. A devitrifying frit is compounded as a viscous glass which crystallizes and hardens when heated to a predetermined temperature, and which does not remelt upon reheating so that a permanent bond is made.

Shadow mask 36 is shown as having a first field of aperture 48 therein which provide for color selection in the finished tube, and a second field of apertures 50 peripheral to the first field. Peripheral apertures 50 comprise cementpassing apertures sized to pass cement in its viscous state. The cement can be the heretofore-described devitrifying glass frit. The embodiment of the shadow mask 36 as shown is not the subject of the present application, but is fully described and claimed in referent copending application Ser. No. 729,020.

In the prior embodiment shown by FIGS. 2 and 3, tube 12 is indicated as having internal indexing means for interregistering the faceplate 16 and frame 18. The sets of indexing means, typically three in number, are internally spaced at preselected locations about the periphery of the faceplate 12; one of the sets is shown in FIGS. 2 and 3 at 52. Indexing means 52 in this prior embodiment is depicted as comprising a ball 54 which rides in mating grooves 56 and 58 in the faceplate sealing surface 42 and the support surface 44 of frame 16, respectively. The frame 18 and funnel 20 of tube 12 are shown as being joined by a third layer of cement 60 (which may also be a devitrifying glass frit) at the frame-funnel junction. As a result, the color electrode assembly 34 is sealed integrally between faceplate 16 and the rear section of the color cathode ray tube envelope so as to become an integral part of the envelope.

With regard to the preferred embodiment of the present invention, and with reference to FIG. 4, there are shown two components-in-process according to the invention. The first component-in-process has a faceplate 70 With a target area 72 for receiving at least one pattern of phosphor deposits 74, indicated schematically; the patterns have been noted as comprising red-, green- and blue-light-emitting phosphor deposits. Faceplate 70 has attached at preselected locations on the sides thereof discrete, detachable first indexing elements, one of which is indicated by reference number 76A in FIG. 4. With reference also to FIG. 5, three of these discrete, detachable first indexing elements numbered 76A, 76B and 76C are depicted; the elements are preferably spaced 120 degrees apart, as indicated. The elements are preferably attached by a thermally degradable cement 78, indicated in FIG. 4 as attaching indexing element 76A to faceplate 70.

In the preferred embodiment of the assembly-inprocess, the indexing elements can be temporarily cemented in place by a cement designated as "thermally degradable"; that is, a cement that weakens in strength properties at a specified temperature. The specified temperature is preferably slightly above the temperature at which the devitrifying cement heretofore noted begins to crystallize and become an adhesive cement for permanent bonding of the faceplate to the color electrode assembly; the devitrifying temperature is typically about 430 degrees centigrade. It is desirable that the thermally degradable cement becomes weakened at a slightly higher temperature; e.g., 450 degrees centigrade, which ensures that the faceplate will be maintained in proper registration with the frame until permanent bonding takes place through the devitrification process at the junction of the faceplate and color selection electrode assembly. Following devitrification, the indexing elements according to the invention will become readily detachable. In short, the thermally degradable cement is compounded to become sufficiently weakened upon permanent bonding of the faceplate and shadow mask support assembly, and become so thermally degraded that the indexing elements according to the invention are easily removable upon cooling.

A thermally degradable cement suitable for temporarily attaching the indexing means according to the principles of the invention can be compounded as described in the following paragraphs. The amounts given can be scaled up as necessary to provide quantities for production. While specific suppliers and their designations are cited, equivalent materials supplied by other suppliers may as well be used. Amounts specified are by weight-percent.

Mix well in a plastic or metal bowl the following compounds—

Yellow iron oxide ($Fe_2O_3H_2O$) in a quantity of 2 to 5 weight percent, and panel glass powder in a quantity equal to 80 to 85 weight percent. Mix until a uniform color is obtained.

Continue mixing, while stirring in potassium silicate solution in an amount equal to 10 to 15 solid weightpercent of the total to make a workable (dispensible) viscosity.

The potassium silicate solution may comprise Kasil (R) number 6. This solution is available from PQ Corporation, Valley Forge, Pa. The iron oxide is YLO-2288D manufactured by Pfizer Minerals, Pigments and Metals Division, New York, N.Y.

With respect to the powdered glass, it is recommended that the powdered glass component be actual faceplate glass reduced to a 100 mesh powder by means wellknown in the art, such as ball milling. The use of faceplate glass as the source of the powdered glass ensures that the thermal coefficient of expansion of the cement will be substantially the same as the glass of the faceplate to which the indexing means according to the invention are attached.

The thermally degradable cement as compounded airdries in about 2 hours after it is applied. Its shelf life is about 6 months when stored in a tightly stoppered plastic bottle.

As indicated by FIG. 4A, each of the elements 76A (-B, -C) has an indexing groove therein (designated respectively as 79A, 79B and 79C) which is "substantially radially oriented"; that is, the major axis of each elongated indexing groove is substantially oriented to pass through center point 80 of faceplate 70, as indicated by FIGS. 4A and 5.

A second component-in-process according to the invention comprises a shadow mask support frame 82 (indicated by the bracket) which ultimately constitutes a part of the tube envelope for supporting a tensed-foil shadow mask 84 in precise adjacency to the target area 72. As indicated by FIG. 4, and as shown by FIG. 5, frame 82 has attached by thermally degradable cement on the sides thereof three discrete, detachable second indexing elements 86A, 86B and 86C which are in facing adjacency to the first indexing elements 76A, 76B and 76C on faceplate 70 when faceplate 70 and frame 82 are mated. With reference again to FIG. 4A, indexing element 86A (as well as indexing elements 86B and 86C) has an indexing groove (not reference-numbered) therein facing a respective indexing groove 79A, 79B or 79C in indexing elements 76A, 76B or 76C. Indexing element 86A is indicated as being attached by a cement 88, noted heretofore as being thermally degradable; indexing elements 86B and 86C are also so attached.

Indexing elements 76A, 76B, 76C, and facing indexing elements 86A, 86B, 86C, are adapted to receive balls 90A, 90B and 90C, respectively, therebetween. Balls 90A, 90B, and 90C may be captivated according to the invention by temporary ball-retention means 92A, 92B and 92C. Ball-retention means 92A is indicated as being attachable by expandible spring clips 93 to at least one of each of the adjacent indexing elements; in this FIG. 4 example, indexing element 86A. As indicated by FIG. 5 and reference numbers 92B and 92C, there is a ball-retention means for each pair of indexing elements. The ball-retention means, designated as "temporary," are removed following the final screening process.

The indexing elements described, indicated as being attached to the first and second components-in-process in conjunction with the associated ball-and-groove indexing means, provide for precisely registering faceplate 70 and frame 82 in temporary assembly for the repetitive process of screening the pattern of phosphor deposits on the target area 72 and later in the final assembly of the tube. An assembly-in-process according to the invention comprises a first component-in-process and a second component-in-process for use in the manufacture of a high-resolution color cathode ray tube having a tensed foil shadow mask.

As noted in the background section, the faceplate and the frame must be precisely registered in temporary assembly for the repetitive process of screening each pattern of phosphor deposits on the target area and later in the final assembly of the tube. With reference to FIG. 4, the section of the cathode ray tube shown is indicated as being finally assembled; that is, the components including the faceplate 70, frame 82, and funnel 100 of the tube envelope are permanently bonded into an integral entity from which air can be evacuated. (A cathode ray tube assembled in toto is depicted in FIGS. 1 and 2). Faceplate 70 is indicated as being bonded to frame 82 by a layer of devitrifying frit 94. The bead of frit 96 used for attaching the shadow mask 84 to the shelf of frame 82, and the layer of frit 98, shown as attaching frame 82 to funnel 100, may also comprise a devitrifying frit.

Figure 6:
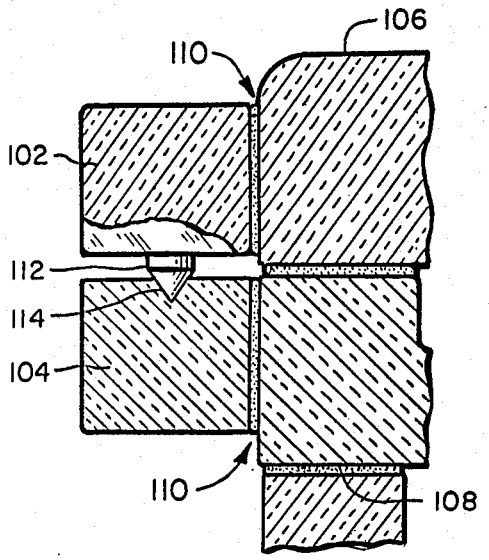
FIG. 6 is an elevational view in section of an alternate means of registration according to the inventive means and method.

According to another aspect of the invention, the indexing elements of the components-in-process and assembly-in-process may comprise indents and conforming detents. This configuration is shown by FIG. 6 wherein indexing elements 102 and 104 are shown as being attached to faceplate 106 and frame 108, respectively, by layers 110 of thermally degradable cement. A cone-shaped detent 112 is shown as extending from indexing element 102 for mating with conforming indent 114 on indexing element 104. The detent 112 could as well extend from indexing element 104 to mate with a conforming indent in indexing element 102. The indexing elements shown; that is, a cone-shaped detent mating with a conforming indent, could as well be in the form of a bullet-shaped member or any other indent-detent pair suitable for precise indexing.

An improved method according to the invention for screening a pattern of phosphor deposits on the target area, and for final assembly of the tube, is for use in the manufacture of a color cathode ray tube having a tensed foil shadow mask. The method comprises the following:

(a) Attaching a plurality of detachable first indexing elements at preselected locations on the sides of the faceplate. The plurality may comprise, by way of example, three indexing elements spaced 120 degrees apart, with each of the elements having a substantially radially oriented indexing groove therein. The means of attachment may be by a thermally degradable cement.

(b) Attaching a like plurality of detachable second indexing elements at preselected locations on the sides of the frame in facing adjacency to the first indexing elements. The number of elements may be like that of the first indexing elements; that is, three in number, with each element having a substantially radially oriented indexing groove in facing adjacency to a groove in the first indexing elements. Means of attachment is by a thermally degradable cement described heretofore.

(c) Inter-registering the faceplate and the frame by a the use of the first and second indexing elements, and fixedly uniting the faceplate and the frame. The inter-registration is accomplished by inserting a ball between the grooves to interregister the faceplate and the frame. The balls may be held in conjunction with the grooves by temporary ball-retention means attached to at least one element of each of the indexing elements.

(d) Screening the faceplate to deposit patterns of phosphor deposits on the target area.

(e) Applying frit cement to the interface between the faceplate and the frame. The frit cement is of the devitrifying type heretofore described which provides for permanent attachment of the faceplate and the frame.

(f) Again inter-registering the faceplate and the frame by the use of the indexing elements and the balls.

(g) Heating the faceplate and the frame such that the devitrifying cement crystallizes to form a permanent attachment of the faceplate to the frame, and the frame to the funnel, following which the thermally degradable cement decomposes to allow the indexing elements according to the invention to become easily detached.

There are several advantages and benefits obtained in the use of external referencing means as against referencing means located internally. For example, as the referencing means are located outside the periphery of the tube envelope, no space need be taken up by internal referencing means. The indexing means used, such as for example, a ball-and-groove assembly, can be made much larger, thereby providing for more precise registration. Also, the indexing means are visible and "out in the open" so that performance can be checked, and the indexing surfaces can easily be kept clean. Envelope configuration is also simplified as there is no need to frit the indexing means internally into the tube assembly.

Figure 7A:
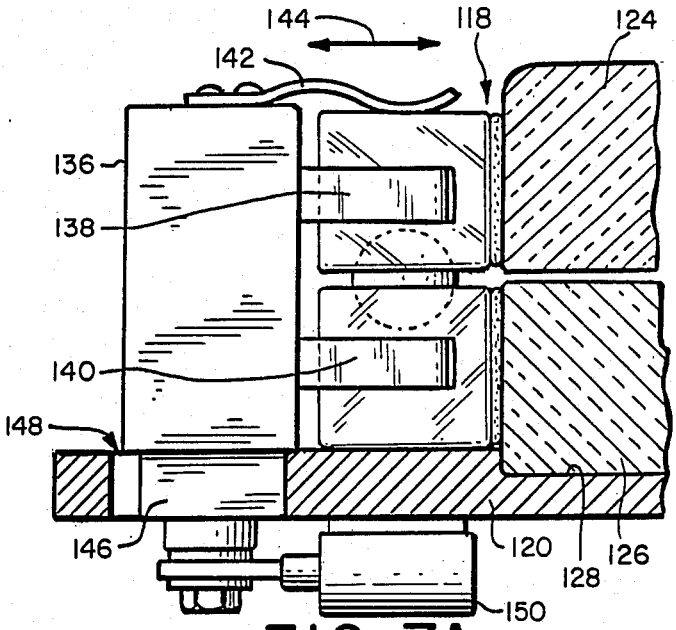
FIG. 7 is a view in perspective of a fixture for attachment of the detachable indexing elements according to the invention; and, FIG. 7A is a sectional side view in elevation showing the details of one of three fixturing components depicted by FIG. 7.
Figure 7:
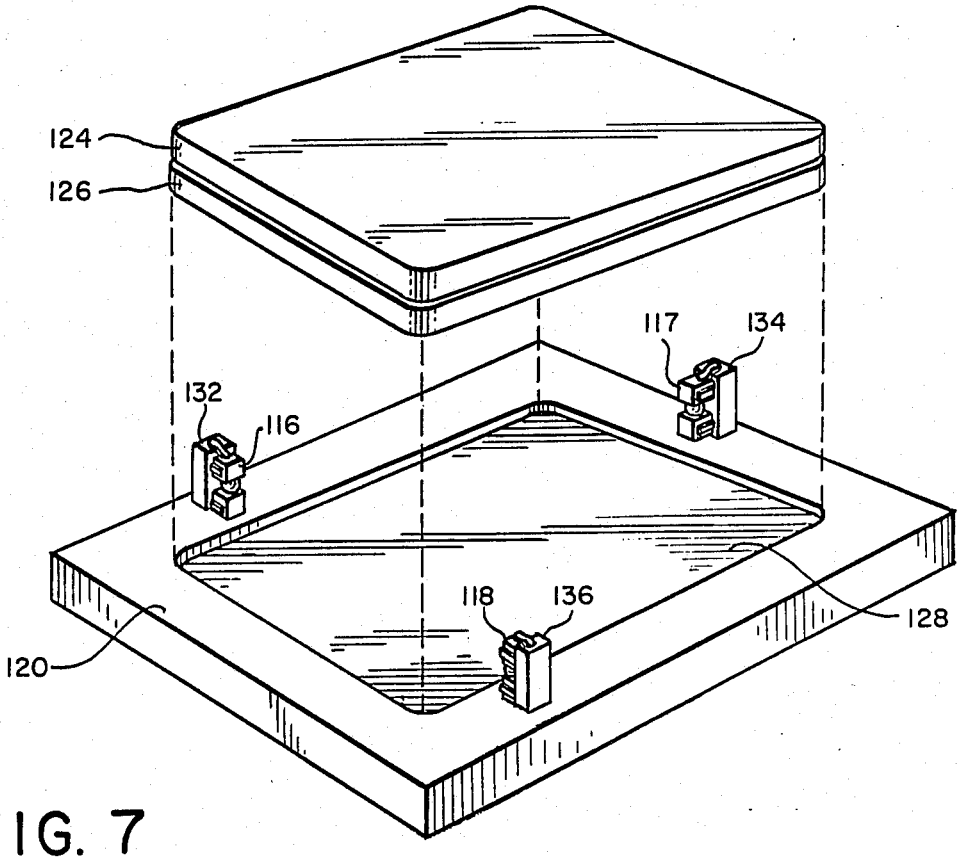

With regard to the means of attachment of the detachable indexing elements according to the invention to the faceplate and frame, a suitable fixture such as that depicted by way of example in FIG. 7 may be used. Three pairs of indexing elements 116, 117 and 118 with associated balls in place are shown as being mounted on fixture 120. A faceplate 124 and a frame 126 are depicted in preparation for lowering onto faceplate-frame receiving bed 128 of fixture 120.

FIG. 7A depicts in detail indexing element holding means 136 (shown by FIG. 7) as holding indexing element pair 118 in contact with faceplate 124 and frame 126. Holding means 136 may provide for holding the three components of indexing elements 118 by means of pairs of spaced spring clips 138 and 140 (the opposed leaf of each pair of spring clips 138 and 140 is not visible in the Figure). Hold-down spring 142 is depicted as holding the indexing elements 118 in firm conjunction. Indexing element holding means 136 (as well as holding means 132 and 134) is shown as being guided in its movement inwardly and outwardly, as indicated by arrow 144, by cam 146, which rides in slot 148. The mechanism for moving the holding means 132, 134 and 136 inwardly and outwardly can take many of the forms well-known to those skilled in the art of making production fixtures. Means for providing movement inwardly and outwardly of holding means 132, 134 and 136 may comprise, by way of example, an electrical solenoid, an air cylinder or a hydraulic cylinder. A solenoid 150 is indicated schematically by FIG. 7A as providing inward and outward movement of holding means 136. A second and a third solenoid (not shown) can provide simultaneous inward and outward movement of holding means 132 and 134.

Attachment of the discrete, detachable indexing elements 116, 117 and 118 according to the invention to the faceplate and frame can be accomplished as follows: Indexing elements 116, 117 and 118 are mounted in conjunction with the retracted holding means 132, 134 and 136. A thermally degradable cement in viscous state is applied to the indexing element surfaces facing the faceplate and frame. Application may be by means of a brush or an automated cement dispenser, examples of which are well-known in the art. The faceplate 124 and frame 126 assembly are lowered onto bed 128 of fixture 120. The holding means 132, 134 and 136 are then caused to move inwardly by the respective solenoids to press the cemented indexing elements firmly against the sides of the faceplate and the frame, as depicted by FIG. 7A. When the cement sets, the indexing elements are firmly attached to the respective sides of the faceplate and the frame. The faceplate-frame assembly is separated and subsequently repetitively inter-registered in precise relationship in the process of screening the patterns of phosphor deposits on the target area of the faceplate and later in final assembly of the tube, as has been described.

In a final step, the faceplate and frame, properly registered by the indexing means according to the invention, are inserted into an oven. (The funnel may be included in this step, for permanent attachment to the frame.) The oven temperature is raised to the point such that the devitrifying frit crystallizes to form a permanent attachment of the faceplate to the frame, and the frame to the funnel. The thermally degradable cement then weakens and decomposes at a slightly higher temperature to allow the indexing elements according to the invention to become easily detached.

While a particular embodiment of the invention has been shown and described, it will be obvious to those skilled in the art that changes and modifications may be made in the inventive means and method without departing from the invention in its broader aspects, and therefore the aim of the appended claims is to cover all such changes and modifications as fall within the true spirit and scope of the invention.

What is claimed is:

1. A flangeless flat faceplate with a target area for receiving at least one pattern of phosphor deposits, said faceplate having a plurality of discrete, detachable indexing elements affixed at preselected, widely spaced locations on the external edges or sides of said faceplate for registration with complementary indexing elements on another member, said detachable indexing elements being attached to said faceplate by a thermally degradable cement.

2. The faceplate according to claim 1 wherein said indexing elements are of the ball-groove type adapted to receive complementary ball-groove indexing elements on said member.

3. A flangeless flat faceplate with a target area for receiving at least one pattern of phosphor deposits by photoscreening using a tensed foil shadow mask as an optical stencil, said faceplate having three discrete, detachable, ball-groove-type indexing elements cemented at preselected, widely spaced locations on the edges or sides of said faceplate by a thermally degradable cement for registration with complementary ball-groove indexing elements associated with said shadow mask, whereby said faceplate can be interregistered in precise relationship with said shadow mask by the temporary use of said indexing elements in the process of photoscreening said pattern of phosphor deposits on said target area.

4. For use in the manufacture of a color cathode ray tube having a tensed foil shadow mask, said tube including a flangeless flat faceplate with a target are, the method comprising:

cementing a plurality of detachable indexing elements at preselected, widely spaced locations on the sides or edges of said faceplate;

photodepositing at least one pattern of phosphor deposits on said target area of said faceplate, including temporarily using said detachable indexing elements to index a photographic stencil with respect to said faceplate; and detaching said detachable indexing elements from said faceplate.

5. The method defined by claim 4 wherein said cementing includes the use of a thermally degradable cement.

6. For use in the manufacture of a color cathode ray tube having a tensed foil shadow mask, said tube including a flangeless flat faceplate with a target area, a method for screening at least one pattern of phosphor deposits on said target area, comprising:

cementing by means of a thermally degradable cement three detachable ball-groove-type indexing elements on the edges or sides of said faceplate;

photodepositing at least one pattern of phosphor deposits on the target area of said faceplate, including temporarily using said detachable indexing elements on said faceplate and complementary indexing means associated with said mask to index said faceplate to said shadow mask; and heating said faceplate such that said thermally degradable cement weakens and decomposes to cause said indexing elements to become easily detached from said faceplate.

7. For use in a color cathode ray tube, a flangeless flat faceplate with a target area for receiving at least one pattern of phosphor deposits, said faceplate having a plurality of ball-groove type indexing means widely spaced on the external periphery of the faceplate for temporary, in-factory use in registering the faceplate.

* * * * *